US005588201A

United States Patent [19]

Alber et al.

[11] Patent Number: 5,588,201

[45] Date of Patent: Dec. 31, 1996

[54] PROCESS FOR PRODUCING A CAST RESIN COIL

[75] Inventors: Friedrich Alber, Köngen; Rudolf Dedelmahr, Aichtal; Winfried Jungnitz, Weilheim-Engelsberg; Hans Schott, Lenningen; Heinz Sesterheim, Kirchheim; Siegfried Weiss, Bissingen, all of Germany

[73] Assignee: Siemens Aktiengesellschaft, Munich, Germany

[21] Appl. No.: 122,424

[22] PCT Filed: Mar. 21, 1991

[86] PCT No.: PCT/EP91/00552

§ 371 Date: Sep. 21, 1993

§ 102(e) Date: Sep. 21, 1993

[87] PCT Pub. No.: WO92/16955

PCT Pub. Date: Oct. 1, 1992

[51] Int. Cl.[6] ..... H01F 7/06

[52] U.S. Cl. ..... 29/605; 29/602.1; 29/606

[58] Field of Search ..... 336/60, 15, 82, 336/96, 123, 145, 199, 205; 29/602.1, 605, 606, 607

[56] References Cited

U.S. PATENT DOCUMENTS

| | | | |
|---|---|---|---|
| 3,668,583 | 6/1972 | Nichols | 336/58 |
| 3,708,875 | 1/1973 | Martincic et al. | 29/605 |
| 4,129,938 | 12/1978 | Hagenbucher | 29/605 |
| 4,488,134 | 12/1984 | Pfeiffer | 336/58 |
| 4,588,972 | 5/1986 | Harumoto et al. | 336/58 |
| 5,034,716 | 7/1991 | Mouadam | 336/60 |
| 5,097,241 | 3/1992 | Smith et al. | 336/60 |
| 5,296,829 | 3/1994 | Kothmann et al. | 336/60 |
| 5,461,772 | 10/1995 | Puri | 29/605 |

FOREIGN PATENT DOCUMENTS

| | | |
|---|---|---|
| 0760347 | 7/1954 | Germany . |
| 1258966 | 1/1968 | Germany . |
| 7126814 | 3/1972 | Germany . |
| 2117204 | 10/1972 | Germany . |
| 2104112 | 9/1978 | Germany . |
| 936380 | 9/1963 | United Kingdom . |

*Primary Examiner*—Bot L. Ledynh
*Attorney, Agent, or Firm*—Kenyon & Kenyon

[57] ABSTRACT

For the production of a cast resin coil consisting of a plurality of axially superimposed flat coils, it is proposed that the corresponding flat coils be first of all produced by winding a first inner partial winding and a second outer partial winding with the interposition of individual spacer members by which sector-shaped intervening spaces are formed. The individual flat coils are then placed together axially and oriented so that their intervening spaces coincide, thus forming axial cooling channels. Moldings are inserted into each of said channels. This is followed by the encapsulation of the assembled flat coils. After the curing of the casting resin, the moldings are removed from the cooling channels. A cast resin coil produced in this manner has an impregnable layer of material, preferably in the region of the cooling channels by which the wall thickness of the cooling channels is predetermined in relation to the corresponding strip conductors.

14 Claims, 2 Drawing Sheets

PROCESS FOR PRODUCING A CAST RESIN COIL

BACKGROUND OF THE INVENTION

The present invention relates generally to processes for producing a cast resin coils,and more particulary to a cast resin coil that consists of a plurality of flat coils superimposed axially on each other, and a cast resin coil thus produced.

German Utility Model 71 26 814 discloses a winding for a transformer which consists of axially superimposed individually wound flat coils. The individual flat coils have intervening spaces between their inner and outer partial windings which lie coaxially one within the other. The partial windings can be wound continuously from the same conductors. The intervening spaces of the corresponding flat coils form, in this connection, axial cooling channels. The winding can be encapsulated in casting resin. It has been found in practice that the encapsulating of the flat coils is very problematical. No solution for this problem is indicated in the German Utility Model.

Up to the present time, therefore, an inner cast resin coil and an outer cast resin coil were produced separately, then placed coaxially one within the other and mechanically connected to each other so that a concentric cooling channel was present between the two cast resin coils.

From U.S. Pat. No. 4,129,938 a process is known for producing an encapsulated winding of wire conductor having cooling channels. For this purpose, after a predetermined number of inner windings, an impregnable non-woven fabric is first of all placed on the winding. Thereupon, moldings which form cooling channels are placed on and an additional layer of the impregnable non-woven fabric is placed over this. An outer partial winding is then applied. The entire winding is encapsulated, the moldings being removed after the encapsulation. Axial cooling channels which are distributed uniformly over the circumference are then produced in the winding. This known winding technique, however, cannot be used in an arrangement consisting of a plurality of flat coils, since the moldings used in the individual flat coils were difficult to remove. Furthermore, the alignment of the intervening spaces of the individual flat coils with respect to each other is difficult.

From British 936 380, there is known the use of a non-woven fabric and of moldings for the forming of cooling channels for transformer coils.

The exact development of the coil, particularly in the transfer region of the coaxially arranged individual coils, is not taken up in any of the documents mentioned.

The present invention is directed to the problem of developing an improved process for producing windings that have cooling channels and are built of several flat coils. The present invention is also directed to the problem of developing an improved cast resin coil with strip conductors.

SUMMARY OF THE INVENTION

The present invention solves the first problem; producing flat coils by winding a first winding consisting of one or more conductors, and then winding one or more additional partial windings on the first winding, wherein the one or more partial windings are wound continuously from the same conductor, or conductors; using individual spacers to form sector-shaped intervening spaces; axially superimposing the flat coils and aligning the sector-shaped intervening spaces, thus forming axial cooling channels; disposing at least one molding into each cooling channel; encapsulating the superimposed flat coils, wherein the thus encapsulated individual spacers form stiffening webs between the partial windings; removing the moldings from the cooling channels; and applying a layer of impregnable material to the partial windings before encapsulating them, at least in the circumferential sections lying between the spacers, wherein the transfer of the conductor or conductors from the first partial winding to the one or more additional partial windings occurs in a connecting web between two adjacent spacers. In this way, a practical process is provided by which the cast resin coil can be produced. A coil produced by this process is characterized by high mechanical strength as well as good cooling action. In particular, flat coils having a plurality of concentrically arranged sector-shaped cooling channels can easily be produced by this process. In this way, cooling the flat coils during operation is substantially improved.

It is favorable if, prior to the encapsulation, a layer of impregnable material is applied to the partial windings at least in the circumferential sections lying between the spacer members. This can be done, for instance, by wrapping a non-woven fabric over its entire circumference. In this way, on the one hand, the partial windings in question are protected from injury when the molding is introduced and, on the other hand, a precisely defined wall thickness of the cooling channels for the partial windings is obtained, whereby, in turn, an improvement in the insulation values is produced. Since no separating foils are used for the insulation, no additional potential boundary surfaces are produced on either wall of the cooling channel.

If the corresponding flat coils with their partial windings are wound continuously from a signal subsequent connecting of said partial windings is unnecessary. It is preferred to employ the process with a strip conductor, which may consist for example of copper or aluminum. The a cast resin coil produced by the method of the present invention The present invention solves the other problem by providing a cast resin coil produced by the method of the present invention. Such a cast resin coil has only very little stress in the cooling channel since only a slight winding stress is present between the partial windings at the cooling channel which are preferably wound continuously from a strip conductor. In this way, the wall thickness of the cooling channel can be made particularly thin which, in its turn, contributes to improved cooling. In this way, material is also saved, so that the weight of the coil is reduced.

Furthermore, the flat coils of the present invention may have greatly differing forms. For example, disc coils or square coils can be used in the present invention.

BRIEF DESCRIPTION OF THE DRAWING

FIG. 1 is a cross section through a cast resin coil, with

DETAILED DESCRIPTION

Figure 1:
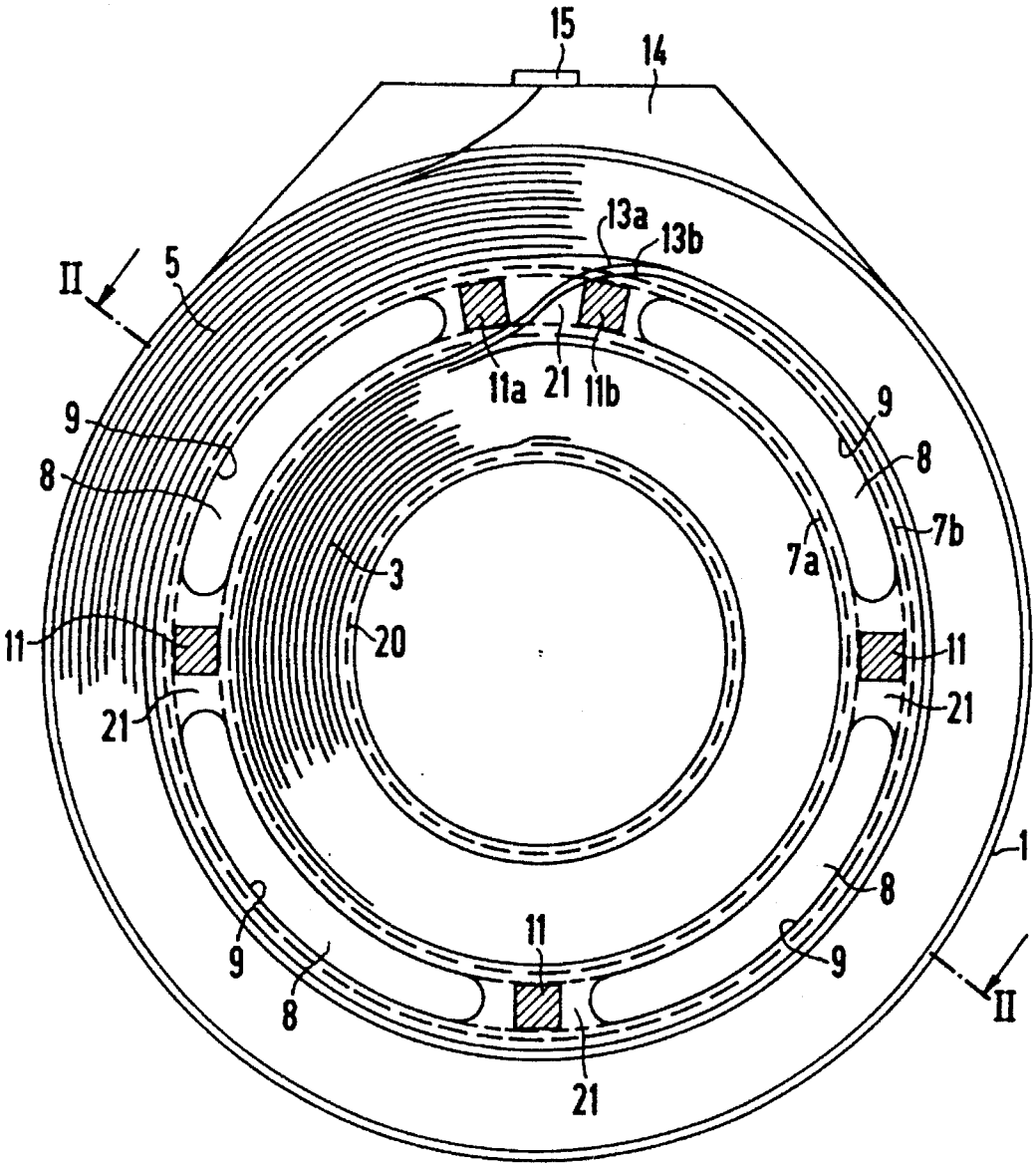

The cross section in FIG. 1 is taken in the plane of a conductor which can be developed as a strip conductor or wire conductor. The cast resin coil has a first inner partial winding 3 and a second outer partial winding 5, which windings are arranged concentrically to each other. The inner partial winding 3 can, in this case, be arranged on a coil former or else be wound in self-supporting manner.

On the circumference of the inner partial winding 3, a layer of impregnable material 7*a* can, if desired, be applied (showed in dashed line). Adjoining it in radial direction there are furthermore first of all spacer members 11, 11*a*, 11*b*, another layer of material 7*b* and the outer partial winding 5. Mats of glass fiber which have a thickness predetermined by their manufacture are for instance suitable as layer 7*a*, 7*b*. The spacer members 11, 11*a*, 11*b* are so arranged on the inner partial winding 3 that they form sector-shaped intervening spaces 8 between the inner and outer windings 3 and 5. The thickness of the spacer members 11 determines, in this connection, the distance between the partial windings 3 and 5. A plurality of intervening spaces 8 lying axially alongside of each other form in each case a cooling channel 9. The layers of material 7*a* and 7*b* determine in this connection the wall thickness of the cooling channel 9 for the conductor of the corresponding partial winding 3, 5.

In the present example, the partial windings 3 and 5 are wound continuously from a single conductor 13*a*. In this connection, winding can also be effected in two layers, the second layer 13*b* being possibly an insulating layer or another conductor which is insulated from the conductor 13*a*. The intervening spaces 8 are sector-shaped portions of a circular ring. The conductor 13 is extended outward in a known a manner at an end part 14 of the cast resin coil 1 at which a connecting element 15 is arranged. A connecting of the conductor 13*a* within the end part 14 to other conductors is also possible.

The spacer members 11, 11*a*, 11*b* can also be arranged directly between the partial windings 3 and 5 without the interpositioning of a layer of material 7*a*, 7*b* so that the layers of material 7*a*, 7*b* rest against the partial windings 3 and 5 only in the region of the intervening spaces 8.

Figure 2:
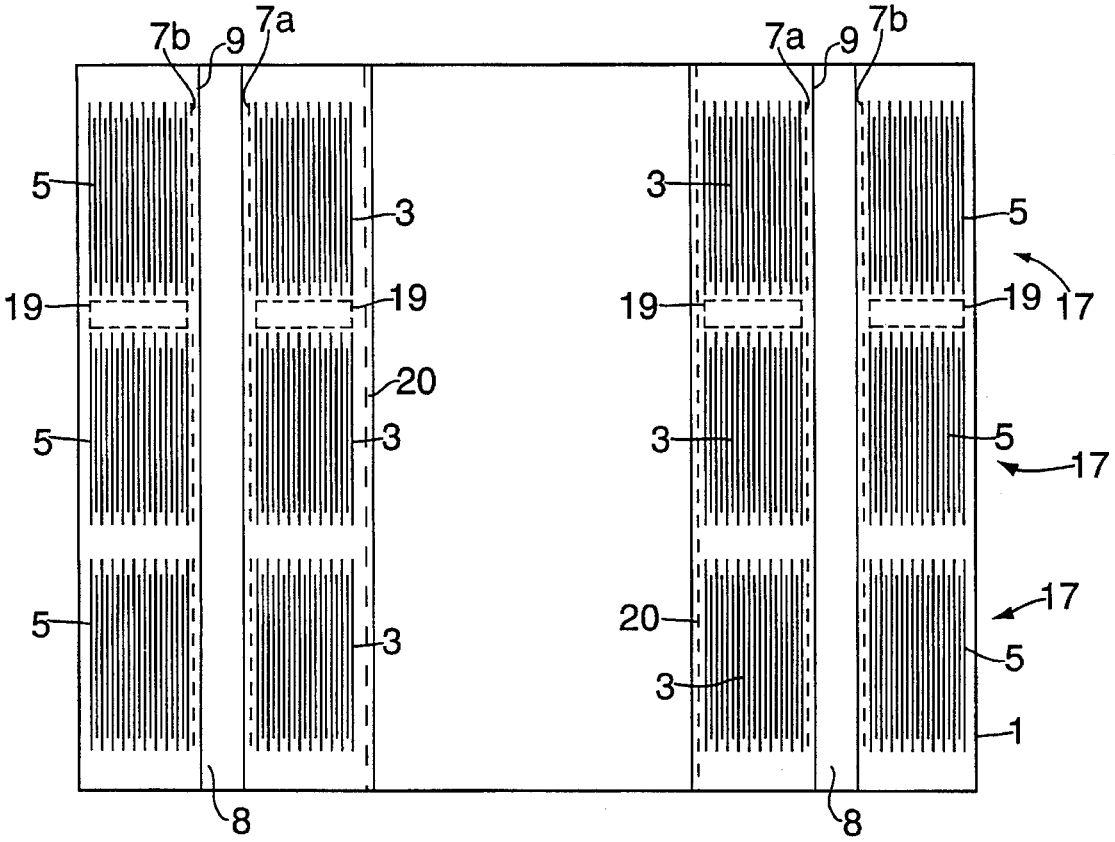
FIG. 2 is a longitudinal section through the cast resin coil of FIG. 1, along the line II—II.

The cast resin coil 1 shown in FIG. 2 is formed of a plurality of flat coils 17 placed alongside of each other which are wound, for instance, from a strip conductor. The flat coils 17 can also be wound from a wire conductor.

The individual flat coils 17 are superimposed axially, in which connection spacer parts 19 can be inserted between the individual flat coils 17 (as shown in dashed line). It can be noted in the embodiment shown that the layers of material 7*a*, 7*b* extend only over the axial width of the flat coils 17. On the other hand, if the layers of material 7*a*, 7*b* are introduced subsequently into the sector-shaped intervening spaces formed by the spacer bodies 11*a*, 11*b*, of the already superimposed flat coils, the layers of material 7*a*, 7*b* can extend also over the entire length of the arrangement (development similar to the spacing layer 20).

Such a cast resin coil 1 has a very high mechanical strength since the partial windings 3 and 5 are no longer mechanically connected to each other individually as in the prior art but, rather, form a structural unit. In particular, however, the electrical strength is improved, particularly in the region of the cooling channels 9 using a respect to the partial windings 3 and 5. This applies, in particular, to an embodiment with strip conductor since, in such case, only a slight winding tension is still present between the partial windings 3 and 5, which permits a reduction of the wall thickness of the cooling channel 9. In this way, however, an improved cooling of the partial windings 3 and 5 is also possible.

The partial windings of the flat coils 17 can be wound continuously from a conductor 13*a*, so that no additional expense for external connection is necessary. The transfer of the conductor 13*a* from the inner partial winding 3 to the outer partial winding 5 takes place preferably in the region of the spacer members 11*a*, 11*b*, the regions forming connecting webs 21 between the partial windings 3 and 5 after the encapsulation. The transfers of the individual conductors of the corresponding flat coils 17 can, in this case, be arranged in each case one web apart in circumferential direction. In this way, stresses between the transfers can also be reduced. The radial height of the cooling channels 9 is determined essentially by the spacer members 11, 11*a*, 11*b*. This height lies within the range of 5 to 50 mm, and preferably within the range of 10 to 20 mm. Ledges are suitable as spacer member 11, 11*a*, 11*b*, which ledges also may have a profile for guiding the moldings. More than two partial windings 3, 5 can also be arranged concentrically to each other, cooling channels then being arranged in each case between the adjacent partial windings.

The following procedure can be used for the production of a cast resin coil:

The individual flat coils 17 are first of all produced. For this purpose, a first partial winding 3 is wound from one or more conductors 13*a* and, one or more partial windings 5 are wound on it, in each case with the interpositioning of individual spacer members 11, 11*a*, 11*b*.

The spacer members 11, 11*a*, 11*b* are in this connection so arranged, distributed over the circumference of the first partial winding 3, that sector-shaped intervening spaces 8 having the shape of portions of a circular ring are formed. This arranging can be effected during the winding process. If a predetermined number of flat coils 17 is produced, they are superimposed axially, the intervening spaces 8 being aligned in coincidence with each other and forming axial cooling channels 9. As already described above, in this connection the winding transfers of the conductor 13*a* from flat coil 17 to flat coil 17 can be arranged, spaced from each other, in circumferential direction. Thereupon, at least one molding is inserted in each cooling channel 9, the molding extending axially over the entire length of the subsequent cast resin coil, whereby the flat coils 17 are additionally aligned and fixed in position. The moldings used may be discardable or reusable. Their shape is predetermined in accordance with the shape of the cooling channel desired. The cooling channels 9 are sealed from the penetration of casting resin, particularly at their open ends.

This is followed by the encapsulating of the assembled flat coils 17 in known manner. For this purpose, the assembled flat coils 17 are arranged, together with the moldings, in an encapsulating mold and encapsulated with a casting resin. This is effected by the means and process generally known to the person skilled in the art. After the encapsulation and the curing of the encapsulation material, the encapsulation mold and the moldings are removed. If the moldings are reusable, they can for instance be knocked or pressed out. Discardable moldings can be removed, for instance, by destruction or heating.

Prior to the encapsulation, the impregnable layer of material is preferably applied to the partial windings 3 and 5 at least in the circumferential sections lying between the spacer members 11, 11*a*, 11*b* (as already described above). The layer of material 7*a*, 7*b* can, however, also be applied after the flat coils 17 have been placed together by lining the cooling channels 9 with the layer of material 7*a*, 7*b*. This can possibly be effected also with the aid of the moldings onto which the layer of material is laid.

We claim:

1. A process for producing a cast resin coil comprising a plurality of axially superimposed flat coils each of the flat coils including an inner winding, an outer winding, and a plurality of spacers disposed between the inner and outer windings thereby defining a plurality of sector-shaped intervening spaces between the inner and outer windings, said method comprising the steps of:

a) producing a first flat coil by:

winding a first inner winding using a first conductive element;

disposing a first plurality of spacers;

winding a first outer winding from said first conductive element;

applying a first layer of impregnable material between the first inner and outer windings in a first plurality of circumferential sections between each of the first plurality of spacers; and transferring the first conductive element from the first inner winding to the first outer winding in a first connecting web between two of the first plurality of spacers;

b) producing a second flat coil by:

winding a second inner winding using a second conductive element;

disposing a second plurality of spacers;

winding a second outer winding from said second conductive element;

applying a second layer of impregnable material between the second inner and outer windings in a second plurality of circumferential sections between each of the second plurality of spacers; and transferring the second conductive element from the second inner winding to the second outer winding in a second connecting web between two of the second plurality of spacers;

c) axially superimposing said first and second flat coils;

d) aligning said first and second plurality of sector-shaped intervening spaces thereby forming a plurality of axial cooling channels;

e) disposing a molding into each of the plurality of axial cooling channels;

f) encapsulating the superimposed first and second flat coils, whereby the first and second plurality of spacers form stiffening webs between the inner and outer windings when encapsulated; and g) removing every molding from the plurality of axial cooling channels after encapsulation.

2. The method according to claim 1, further comprising the steps of applying a first additional layer of impregnable material on an inner circumferential surface of the first outer winding before encapsulation, and applying a second additional layer of impregnable material on an inner circumferential surface of the second outer winding before encapsulation, wherein said steps of applying first and second layers of impregnable material further comprise applying the first and second layers of impregnable material to an outer circumferential surface of the first and second inner windings, respectively.

3. The method according to claim 1, wherein the first and second conductive elements comprise strip conductors.

4. The method according to claim 2, wherein the first and second conductive elements comprise strip conductors.

5. The method according to claim 1, wherein the first conductive element comprises a first plurality of conductors, the second conductive element comprises a second plurality of conductors, and the first and second inner and outer windings are wound from the first and second plurality of conductors, respectively.

6. The method according to claim 2, wherein the first conductive element comprises a first plurality of conductors, the second conductive element comprises a second plurality of conductors, and the first and second inner and outer windings are wound from the first and second plurality of conductors, respectively.

7. The method according to claim 1, wherein the first conductive element comprises a first plurality of strip conductors, the second conductive element comprises a second plurality of strip conductors, and the first and second inner and outer windings are wound from the first and second plurality of strip conductors, respectively.

8. A process for producing a cast resin coil comprising a plurality of axially superimposed flat coils each of the flat coils including an inner winding, an outer winding, and a plurality of spacers disposed between the inner and outer windings thereby defining a plurality of sector-shaped intervening spaces between the inner and outer windings, said method comprising the steps of:

a) producing a plurality of flat coils by:

winding an inner winding using a conductive element;

disposing a plurality of spacers;

winding an outer winding from said conductive element;

applying a layer of impregnable material between the inner and outer windings in a plurality of circumferential sections between each of the plurality of spacers; and transferring the conductive element from the inner winding to the outer winding in a connecting web between two of the plurality of spacers;

b) axially superimposing said plurality of flat coils;

c) aligning each of said plurality of sector-shaped intervening spaces, whereby a plurality of axial cooling channels are formed;

d) disposing a molding into each of the plurality of axial cooling channels;

e) encapsulating the superimposed plurality of flat coils, whereby the plurality of spacer members form stiffening webs between the inner and outer windings when encapsulated; and f) removing every molding from the plurality of axial cooling channels after encapsulation.

9. The method according to claim 8, further comprising the step of applying an additional layer of impregnable material on an inner circumferential surface of the outer winding of each of the plurality of flat coils, wherein said step of applying the layer of impregnable material further comprises applying the layer of impregnable material to an outer circumferential surface of the inner winding.

10. The method according to claim 8, wherein the conductive element for each of the plurality of flat coils comprises a strip conductor.

11. The method according to claim 9, wherein the conductive element for each of the plurality of flat coils comprises a strip conductor.

12. The method according to claim 8, wherein the conductive element for each of the plurality of flat coils comprises a plurality of strip conductors, and the inner and outer windings of each of the plurality of flat coils are wound from the plurality of strip conductors.

13. The method according to claim 9, wherein the conductive element for each of the plurality of flat coils comprises a plurality of strip conductors, and the inner and outer windings of each of the plurality of flat coils are wound from the plurality of strip conductors.

14. A process for producing a cast resin coil comprising a plurality of axially superimposed flat coils each flat coil including an inner winding, an outer winding, and a plurality of spacers disposed between the inner and outer windings thereby defining a plurality of sector-shaped intervening spaces between the inner and outer windings, said method comprising the steps of:

a) producing a plurality of flat coils by:

winding an inner winding using a conductive element;

disposing a plurality of spacers; and winding an outer winding from said conductive element;

transferring the conductive element from the inner winding to the outer winding in a connecting web between two of the plurality of spacers;

b) axially superimposing said plurality of flat coils;

c) aligning each of said plurality of sector-shaped intervening spaces, whereby a plurality of axial cooling channels are formed;

d) applying a layer of impregnable material at least on an outer and an inner circumferential surface of each of said plurality of axial cooling channels;

e) disposing a molding into each of the plurality of axial cooling channels;

f) encapsulating the superimposed plurality of flat coils, whereby the plurality of spacer members form stiffening webs between the inner and outer windings when encapsulated; and g) removing every molding from the plurality of axial cooling channels after encapsulation.

* * * * *